US009253868B1

(12) United States Patent
Nam et al.

(10) Patent No.: US 9,253,868 B1
(45) Date of Patent: Feb. 2, 2016

(54) NEUTRAL BEAM SOURCE WITH PLASMA SHEATH-SHAPING NEUTRALIZATION GRID

(71) Applicant: APPLIED MATERIALS, INC., Santa Clara, CA (US)

(72) Inventors: Sang Ki Nam, Danville, CA (US); Ludovic Godet, Sunnyvale, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 0 days.

(21) Appl. No.: 14/549,854

(22) Filed: Nov. 21, 2014

(51) Int. Cl.
*H05H 3/02* (2006.01)

(52) U.S. Cl.
CPC ..... *H05H 3/02* (2013.01)

(58) Field of Classification Search
USPC ..... 250/251, 526, 492.21, 492.3; 204/192.3, 192.31, 192.32, 192.34, 204/192.35; 427/551, 595; 216/37, 62, 66, 216/67, 94
See application file for complete search history.

(56) References Cited

U.S. PATENT DOCUMENTS 4,873,467 A * 10/1989 Kaufman ..... H01J 27/024 313/268
6,065,499 A * 5/2000 Pless ..... F16L 51/025 138/118
8,944,385 B2 * 2/2015 Harmann ..... F03H 1/0062 244/171.1
2005/0174063 A1 * 8/2005 Kornfeld ..... H05H 1/54 315/111.61
2005/0212442 A1 * 9/2005 Kornfeld ..... F03H 1/00 315/111.61
2011/0073713 A1 * 3/2011 Harmann ..... B64G 1/405 244/171.1
2011/0080085 A1 * 4/2011 Harmann ..... F03H 1/0062 313/359.1
2013/0032708 A1 * 2/2013 Kern ..... H01J 49/02 250/281

OTHER PUBLICATIONS

A. W. Molvik, R. H. Munger, T. J. Duffy, and D. L. Correll, "Geometrically focused neutral beam accelerators", Review of Scientific Instruments 52, 965 (1981).*
U.S. Patent Application as filed Nov. 21, 2014 in Co-Pending U.S. Appl. No. 14/549,829.
Panda, S., et al. "Anistropic etching of polymer films by high energy oxygen atom neutral beams", J. Vac. Sci. Technol. A., 2001, pp. 398-404, 19(2), USA.
Ichiki, K., et al. "Characterization of neutral beam source using dc cold cathode discharge and its application processes", J.Phys. D: Appl Phys., 2008, pp. 1-14, V 41, USA.
Economou, D. J. "Fast (tens to hundreds of eV) neutral beams for materials processing", J. Phys. D: Appl. Phys., 2008, pp. 1-11, V 41, USA.
Economou, D.J. "Modeling and Simulation of Fast Neutral Beam Sources for Materials Processing", Plasma Process. Polym. Journal, 2009, pp. 308-319, V 6, Germany.

* cited by examiner

*Primary Examiner* — Bernard E Souw
(74) *Attorney, Agent, or Firm* — Robert M. Wallace

(57) ABSTRACT

A neutral beam source has a plasma sheath-shaping neutralization grid that shapes a plasma sheath near a beam-forming slit of the neutralization grid in accordance with a desired entry angle of incoming ions in the slit.

20 Claims, 4 Drawing Sheets

NEUTRAL BEAM SOURCE WITH PLASMA SHEATH-SHAPING NEUTRALIZATION GRID

BACKGROUND

1. Technical Field

The disclosure concerns a neutral beam source in which the ion beam is directed to the neutralization grid at an angle determined by the configuration of the neutralization grid.

2. Background Discussion

Treatment modification of surface material of a workpiece such as a semiconductor wafer using an ion beam is well-known. Such treatment may include localized film property modification by a directional beam to enable selectivity improvement. Surface properties may be altered to enhance or inhibit nucleation, deposition and etching of the material. Use of an ion beam for such purposes involves certain limitations. For example, there is no independent control of beam angle and beam energy for an ion beam. Further, the ion beam spreads as it propagates toward the workpiece due to space charge. More importantly, the ion beam charges the surface of the workpiece, which can lead to damage of features formed on the workpiece. One solution to such problems is to employ a neutral beam instead of an ion beam. One need is to provide for optimization of the angle at which the ion beam strikes side walls of the neutralization grid for maximum neutral flux for a given incoming ion flux.

SUMMARY

A system for processing a workpiece comprises: a plasma source chamber having an opening; a neutralization grid covering the opening and comprising a pair of grid elements having opposing parallel side walls facing one another and separated by an elongate slit defining a beam path and defining an elongate beam shape, the pair of grid elements further comprising respective top surfaces facing the opening; wherein the respective top surfaces are in respective planes offset from one another along the beam path direction by an offset distance corresponding to a desired non-zero angle between a trajectory of incoming ions from the plasma chamber and the opposing parallel side walls.

In one embodiment, the system further comprises a movable support stage having a workpiece support surface lying in the beam path, the elongate beam shape corresponding to an elongate beam impact zone on a workpiece surface of a workpiece supported on the support stage; and a scan servo coupled to the movable support stage and having a translation direction transverse to the elongate beam impact zone.

In one embodiment, a voltage source is connected to the neutralization grid. The voltage source in one embodiment comprises one of electrical ground, a D.C. voltage supply or an RF voltage supply.

In one embodiment, the neutral beam source further comprises: a plasma source power applicator on or adjacent the plasma chamber and a plasma source power supply coupled to the plasma source power applicator; and a process gas supply coupled to the plasma chamber.

In one embodiment, the pair of top surfaces comprises a floor of the plasma chamber. In one embodiment, the pair of top surfaces are orthogonal to the pair of side walls.

In one embodiment, the pair of grid elements are electrically conductive.

In one embodiment, the neutral beam source further comprises respective guard grids lying between respective ones of the grid elements and the opening of the plasma chamber. In one embodiment, each of the guard grids is an electrically conductive body having a surface facing and separated from a respective one of the top surfaces by a gap.

In one embodiment, the angle is in a range of 5 degrees to 30 degrees.

In a different aspect, a neutral beam source comprises: a plasma source chamber having an opening; a neutralization grid covering the opening and comprising a pair of grid elements having opposing parallel side walls facing one another and separated by an elongate slit defining a beam path and defining an elongate beam shape, the pair of grid elements further comprising respective top surfaces facing the opening; a middle grid element between and separate from the pair of grid elements and having a length along the beam path less than a length of the pair of grid elements along the beam path direction, the middle grid element having a middle grid top surface facing the opening; wherein each of the respective top surfaces is in a respective plane offset from a plane of the middle grid top surface along the beam path direction by a middle grid offset distance corresponding to a desired non-zero angle between a trajectory of incoming ions from the plasma chamber and the opposing parallel side walls.

In one embodiment, the middle grid top surface is closer to the opening than the pair of grid elements. In another embodiment, the middle grid top surface is farther from the opening than the pair of grid elements.

In one embodiment, the neutral beam source further comprises: a plasma source power applicator on or adjacent the plasma chamber and a plasma source power supply coupled to the plasma source power applicator; and a process gas supply coupled to the plasma chamber.

In one embodiment, the pair of top surfaces comprise a floor of the plasma chamber. In one embodiment, the pair of top surfaces are orthogonal to the pair of side walls.

In one embodiment, the neutral beam source further comprises respective guard grids lying between respective ones of the grid elements and the opening of the plasma chamber. One embodiment further comprises a middle guard grid lying between the middle grid element and the opening of the plasma chamber.

BRIEF DESCRIPTION OF THE DRAWINGS

So that the manner in which the exemplary embodiments of the present invention are attained can be understood in detail, a more particular description of the invention, briefly summarized above, may be had by reference to the embodiments thereof which are illustrated in the appended drawings. It is to be appreciated that certain well known processes are not discussed herein in order to not obscure the invention.

Figure 1:
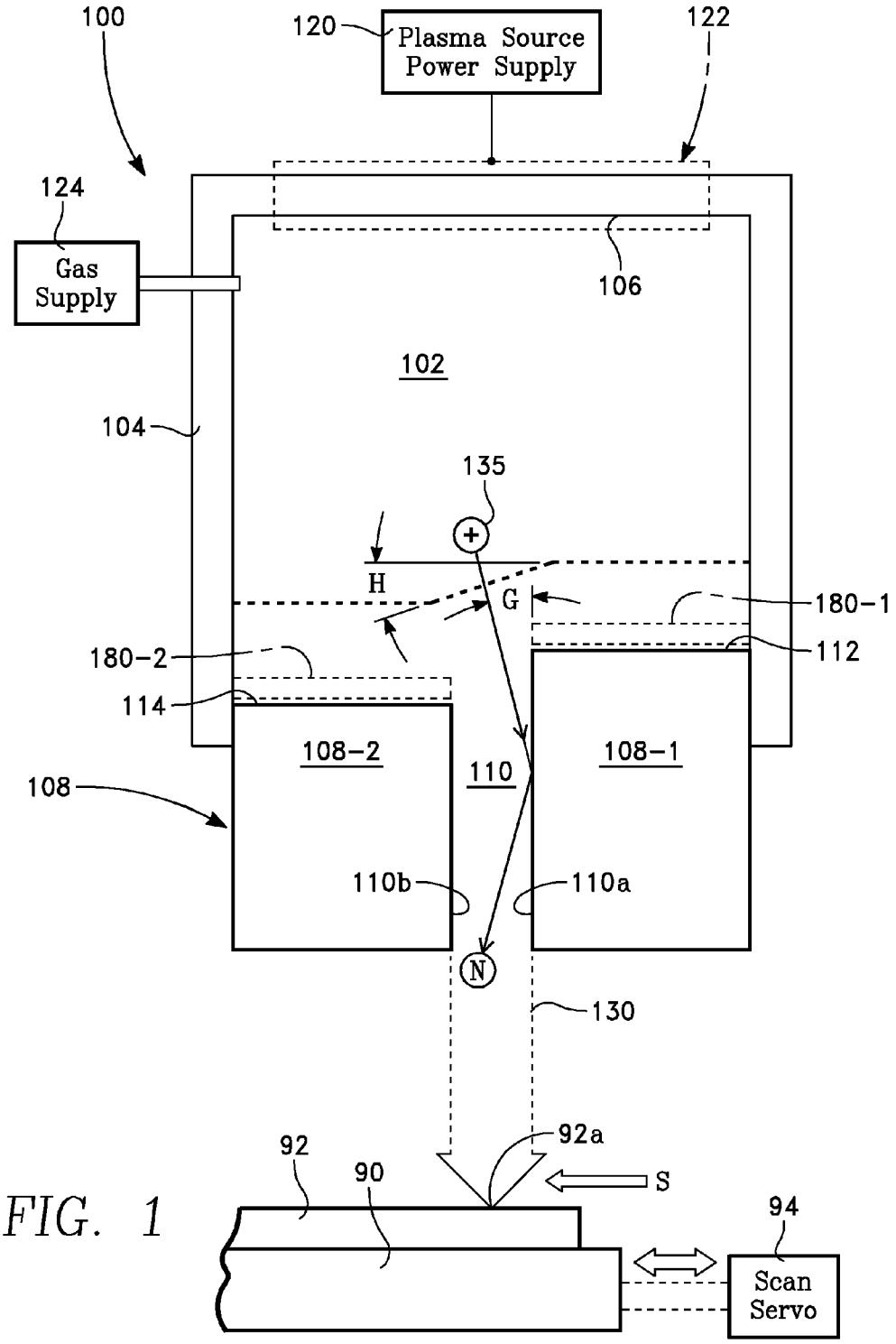
FIG. 1 depicts a workpiece processing system including a neutral beam source in accordance with a first embodiment.

To facilitate understanding, identical reference numerals have been used, where possible, to designate identical elements that are common to the figures. It is contemplated that elements and features of one embodiment may be beneficially incorporated in other embodiments without further recitation. It is to be noted, however, that the appended drawings illustrate only exemplary embodiments of this invention and are therefore not to be considered limiting of its scope, for the invention may admit to other equally effective embodiments.

DETAILED DESCRIPTION

Figure 1A:
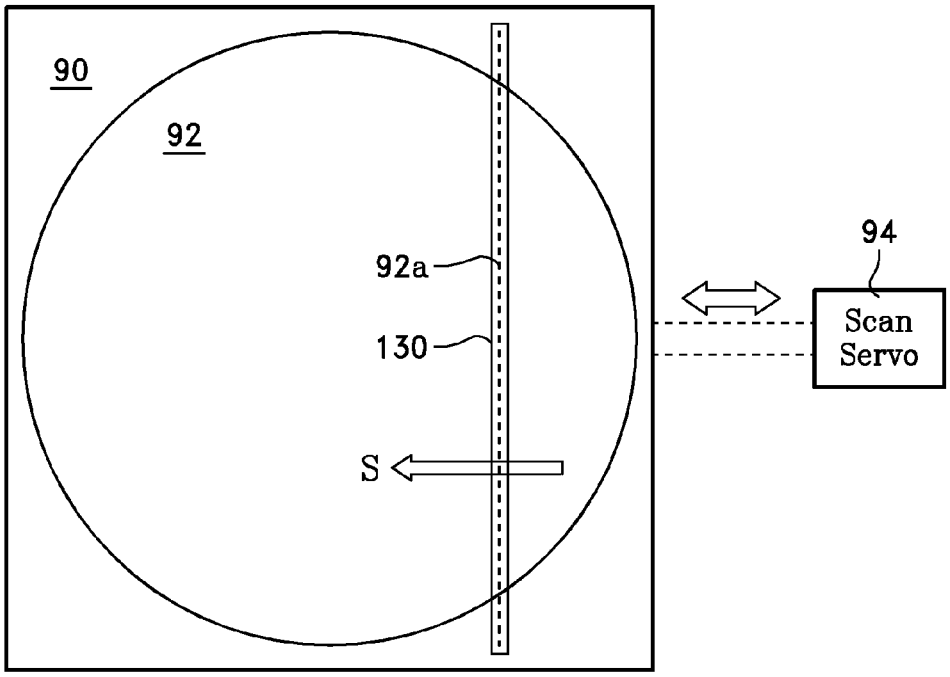
FIG. 1A is a plan view corresponding to FIG. 1.

Referring to FIGS. 1 and 1A, system for treating a workpiece with a neutral beam includes a support stage 90 for supporting a workpiece 92 such as a semiconductor wafer. A scan servo 94 translates the support stage 90 along a scan direction S. As will be described below, the scan direction S is perpendicular (or transverse) to an elongate beam impact zone 92*a* of a sheet-like line beam 130 of neutral species on the surface of the workpiece 92. The system further includes a neutral beam source 100 including a plasma chamber 102 enclosed by side walls 104, a ceiling 106 and a neutralization grid 108. The neutralization grid 108 is formed of an electrically conductive material and has a pair of grid elements 108-1, 108-2 separated at a single elongate slit 110 that opens into the interior of the plasma chamber 102. The neutralization grid 108 may be connected to ground or may be connected to an RF or D.C. voltage source. The elongate slit 110 has opposing interior side walls 110*a* and 110*b* formed as facing surfaces of respective ones of the pair of grid elements 108-1, 108-2. The grid elements 108-1, 108-2 have respective top surfaces 112, 114 facing the interior of the plasma chamber 102.

A plasma source power supply 120 provides power to a plasma source power applicator 122 on or adjacent the plasma chamber 102. The plasma source power supply 120 may be a microwave generator, an RF power generator with an impedance match or a D.C. power supply, for example. The plasma source power applicator 122 may be a microwave waveguide, an electrode or an RF-driven coil, for example. A gas supply 124 provides a process gas into the plasma chamber 102. Plasma source power is coupled into the chamber by the plasma source power applicator 122 and ionizes the process gas to generate a plasma within the plasma chamber 102. Ions of the plasma exit the plasma chamber 102 through the elongate slit 110, and their energy may be controlled by controlling the voltage of the neutralization grid 108. The ions undergo glancing collisions with the interior side walls 110*a*, 110*b* as they exit through the elongate slit 110. Such glancing collisions transform the ions to neutral species, producing a line beam 130 of neutral species emanating from the elongate slit 110. The line beam 130 is shaped as a sheet whose thickness corresponds to the distance between the interior side walls 110*a*, 110*b*, and strikes the workpiece 92 to form the elongate beam impact zone 92*a*. Translation of the support stage 90 by the scan servo 94 causes the neutral beam to be scanned across the surface of the workpiece 92 along a direction perpendicular to the long dimension of the elongate beam impact zone 92*a*.

The flux of neutrals in the line beam 130 is affected by a collision angle G (shown in FIG. 1) between the direction or trajectory of the incoming ions from the plasma chamber 102 (e.g., the ion 135 of FIG. 1) and the interior side wall 110*a* of the elongate slit 110. For very large values of the collision angle G, the neutrals produced by initial collisions with the side walls 110*a*, 110*b*, tend to bounce or ricochet between the side walls 110*a*, 110*b* a greater number of times, and a greater proportion of the neutrals may be absorbed by collisions with the side walls 110*a*, 110*b* rather than contributing to the line beam 130. For smaller values of the collision angle G, the trajectory of the incoming ions is nearly parallel with the side walls 110*a*, 110*b*, and the number of collisions may be minimal, which can reduce the number of neutrals produced for a given number of incoming ions. Between these two extremes, there generally is an ideal value of the collision angle G at which a maximum number of the incoming ions have glancing collisions with the side walls 110*a*, 110*b*, producing neutrals which survive passage through the elongate slit 110 to form the line beam 130.

The problem is how to set the collision angle G to an optimum value. Embodiments disclosed herein enable a user to set the collision angle G to a desired value at which neutral flux is optimum. The collision angle G is controlled or set in accordance with plasma sheath-shaping features of the neutralization grid 108 which shapes the plasma sheath to produce the desired collision angle G of the incoming ions.

In the embodiment of FIG. 1, the collision angle G is set to a desired value by positioning the pair of grid elements 108-1, 108-2 in a non-symmetrical manner in which the top surfaces 112, 114 of the respective grid elements 108-1, 108-2 are offset so as to lie in different planes. Specifically, in the embodiment of FIG. 1, the top surface 112 is higher (e.g., closer to the center of the plasma chamber 102) while the top surface 114 is lower, in the view of FIG. 1. This feature presents a stepped boundary to plasma at the bottom of the plasma chamber 102. A plasma sheath 150 at the bottom of the plasma chamber 102 is shaped by this stepped boundary. As depicted in FIG. 1, the portion of the plasma sheath 150 overlying the elongate slit 110 lies at an angle H relative to the top surface 112. The trajectory of the incoming ions is generally perpendicular to the plasma sheath 150. As a result, the direction of the incoming ions is angled relative to the side walls 110*a*, 110*b* of the elongate slit 110, as depicted in FIG. 1. The collision angle G of the incoming ions is influenced by the angle H of the portion of the plasma sheath 150 overlying the elongate slit 110. By increasing the offset between the top surfaces 112, 114, the collision angle G is increased. Likewise, by decreasing the offset between the top surfaces 112, 114, the collision angle G is decreased.

Figure 2:
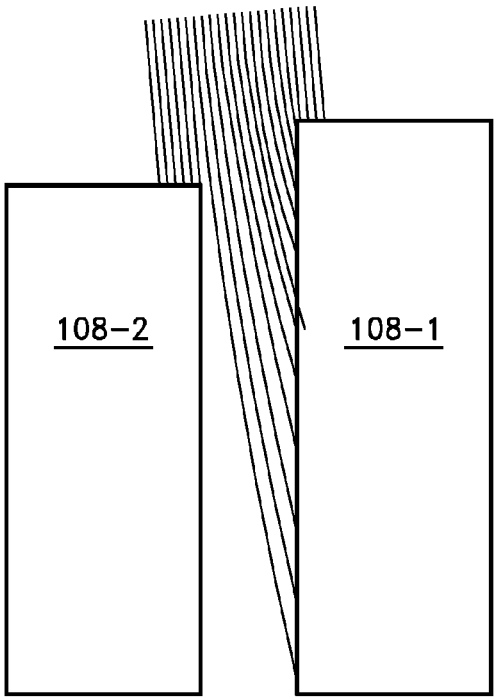
FIG. 2 is a cross-sectional view of a neutralization grid of the neutral beam source of FIG. 1 and depicts predicted paths of ions and neutrals within the neutralization grid.

FIG. 2 is a cross-sectional view of the neutralization grid 108 of FIG. 1 and depicts shaping of the plasma sheath in the embodiment of FIG. 1 and a resulting distribution of incoming ion trajectories relative to features in the surface of a workpiece. FIG. 2 illustrates how the collision angle G of the incoming ions is distributed over the path through the elongate slit 110.

Figure 3:
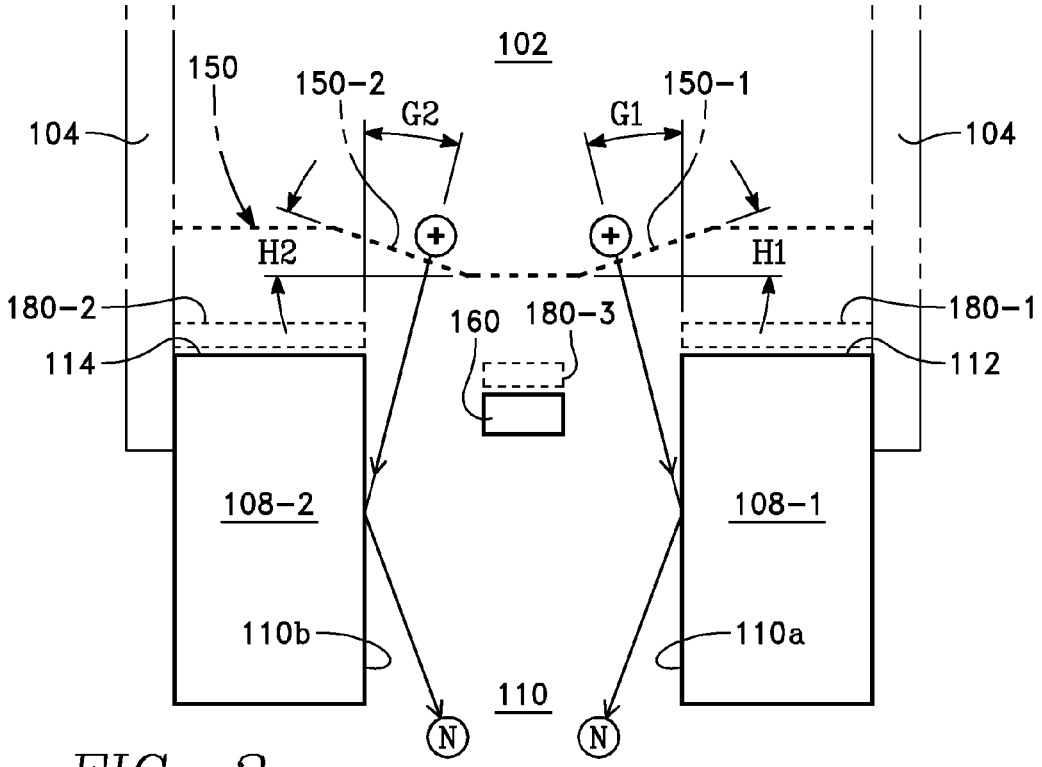
FIG. 3 depicts a workpiece processing system including a neutral beam source in accordance with a second embodiment.
Figure 4:
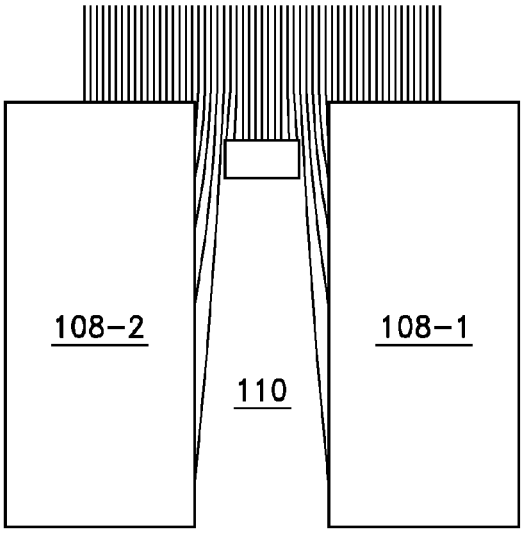
FIG. 4 is a cross-sectional view of a neutralization grid of the neutral beam source of FIG. 3 and depicts predicted paths of ions and neutrals within the neutralization grid.

FIG. 3 depicts a modification of the embodiment of FIG. 1 in which a center grid element 160 is placed between the pair of grid elements 108-1, 108-2 and below the planes of the top surfaces 112 and 114. A first portion 150-1 of the plasma sheath 150 overlying the space between the center grid element 160 and the grid element 108-1 lies at a first angle H1. A second portion 150-2 of the plasma sheath 150 overlying the space between the center grid element 160 and the grid element 108-2 lies at a second angle H2 supplementary to H1. Incoming ions passing through the first and second portions 150-1, 150-2 of the plasma sheath strike respective ones of the side walls 110*a*, 110*b* at respective collision angles G1, G2 determined by the angles H1 and H2 of the first and second portions 150-1, 150-2. The collision angles G1 and G2 may be adjusted by setting the height of the center grid element 160 relative to the top surface 112 or 114. Alternatively or in addition, the collision angles G1 and G2 may be adjusted by applying a D.C. or RF voltage to the center grid element 160 and adjusting the voltage. FIG. 4 is a cross-sectional view of the neutralization grid of FIG. 3 and depicts predicted ion trajectories.

Figure 5:
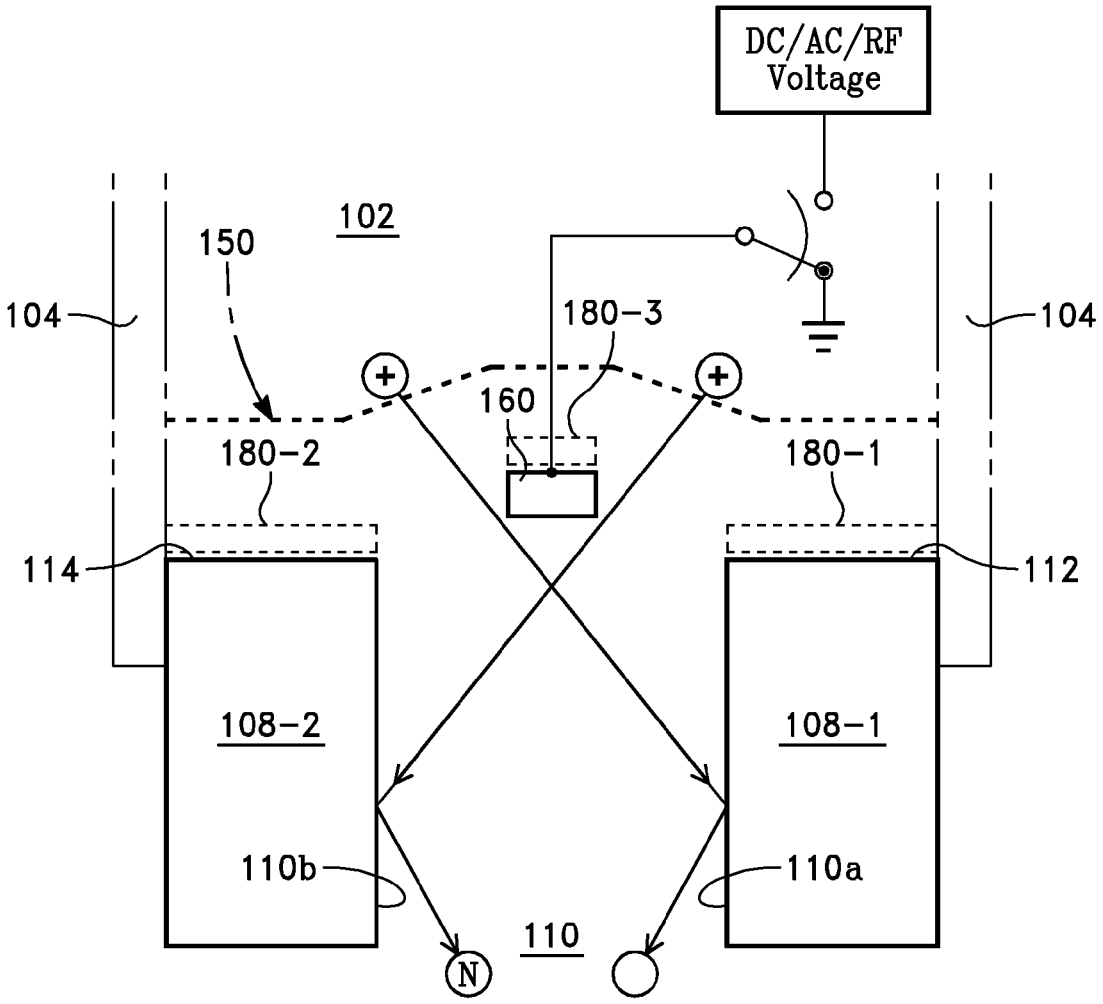
FIG. 5 depicts a workpiece processing system including a neutral beam source in accordance with a third embodiment.

FIG. 5 depicts a modification of the embodiment of FIG. 3, in which the center grid element 160 is placed above the top surface 112 or 114.

In the embodiments of FIGS. 1-5, a D.C. or RF voltage (or a combination of both) may be applied to the neutralization grid 108. Depending upon the applied voltage, the neutralization grid 108 may attract incoming ions with high energy from the plasma chamber 102, which can damage the neutralization grid 108. Another problem is that the plasma distribution near the neutralization grid 108 may be disturbed by the voltage applied to the neutralization grid 108.

The problems of possible damage or disturbance are solved by providing a guard grid overlying the neutralization grid 108. For example, FIG. 1 depicts respective guard grids 180-1, 180-2 overlying and spaced from the top surfaces 112, 114 of the respective grid elements 108-1, 108-2. Each guard grid 180-1, 180-2 is formed of an electrically conductive material and may be grounded, to form a barrier to ions traveling from the plasma chamber 102. Each guard grid 180-1, 180-2 has a rectangular shape conforming to a rectangular shape of the top surface 112, 114 of the respective grid elements 108-1, 108-2. The distance separating the respective guard grids 180-1, 180-2 from the respective grid elements 108-1, 108-2 is a small fraction (e.g., less than 0.10) of the length of the respective guard grid 180-1, 180-2 along the length of the beam path. As a further example, FIG. 3 depicts respective guard grids 180-1, 180-2 overlying the grid elements 108-1, 108-2 and a center guard grid 180-3 overlying the center grid element 160. Each guard grid 180-1, 180-2, 180-3 is formed of an electrically conductive material and may be grounded. Similarly, FIG. 5 depicts the respective guard grids 180-1, 180-2 overlying the grid elements 108-1, 108-2 and the center guard grid 180-3 overlying the center grid element 160, the center grid element 160 being elevated in FIG. 5.

ADVANTAGES

Embodiments disclosed herein facilitate control of the collision angle G of the direction of incoming ions relative to the neutralization grid 108 near the elongate slit 110. The collision angle G may be set to a desired value at which a maximum number of the incoming ions have glancing collisions with the side walls 110*a*, 110*b*, producing neutrals which survive passage through the elongate slit 110 to produce the neutral beam 130. The collision angle G is controlled or set in accordance with plasma sheath-shaping features of the neutralization grid 108, which shapes the plasma sheath to produce the desired collision angle G of the incoming ions.

While the foregoing is directed to embodiments of the present invention, other and further embodiments of the invention may be devised without departing from the basic scope thereof, and the scope thereof is determined by the claims that follow.

What is claimed is:

1. A system for processing a workpiece, comprising:

a plasma source chamber having an opening; and a neutralization grid covering said opening and comprising a pair of grid elements having opposing parallel side walls facing one another and separated by an elongate slit defining a beam path and defining an elongate beam shape, said pair of grid elements further comprising respective top surfaces facing said opening;

wherein said respective top surfaces are in respective planes offset from one another along said beam path direction by an offset distance corresponding to a desired non-zero angle between a trajectory of incoming ions from said plasma chamber and said opposing parallel side walls.

2. The system of claim 1 further comprising:

a movable support stage having a workpiece support surface lying in said beam path, said elongate beam shape corresponding to an elongate beam impact zone on a workpiece surface of a workpiece supported on said support stage; and a scan servo coupled to said movable support stage and having a translation direction transverse to said elongate beam impact zone.

3. The system of claim 1 further comprising a voltage source connected to said neutralization grid.

4. The system of claim 3 wherein said voltage source comprises one of electrical ground, a D.C. voltage supply or an RF voltage supply.

5. The system of claim 1 further comprising:

a plasma source power applicator on or adjacent said plasma chamber and a plasma source power supply coupled to said plasma source power applicator; and a process gas supply coupled to said plasma chamber.

6. The system of claim 1 wherein said pair of top surfaces comprise a floor of said plasma chamber.

7. The system of claim 6 wherein said pair of top surfaces are orthogonal to said pair of side walls.

8. The system of claim 1 wherein said pair of grid elements are electrically conductive.

9. The system of claim 1 further comprising respective guard grids lying between respective ones of said grid elements and said opening of said plasma chamber.

10. The system of claim 9 wherein each of said guard grids is an electrically conductive body having a surface facing and separated from a respective one of said top surfaces by a gap.

11. A system for processing a workpiece, comprising:

a plasma source chamber having an opening;

a neutralization grid covering said opening and comprising a pair of grid elements having opposing parallel side walls facing one another and separated by an elongate slit defining a beam path and defining an elongate beam shape, said pair of grid elements further comprising respective top surfaces facing said opening;

a middle grid element between and separate from said pair of grid elements and having a length along said beam path less than a length of said pair of grid elements along said beam path direction, said middle grid element having a middle grid top surface facing said opening; and wherein each of said respective top surfaces are in a respective plane offset from a plane of said middle grid top surface along said beam path direction by a middle grid offset distance corresponding to a desired non-zero angle between a trajectory of incoming ions from said plasma chamber and said opposing parallel side walls.

12. The system of claim 11 further comprising:

a movable support stage having a workpiece support surface lying in said beam path, said elongate beam shape corresponding to an elongate beam impact zone on a workpiece surface of a workpiece supported on said support stage; and a scan servo coupled to said movable support stage and having a translation direction transverse to said elongate beam impact zone.

13. The system of claim 11 wherein said middle grid top surface is closer to said opening than said pair of grid elements.

14. The system of claim 11 wherein said middle grid top surface is farther from said opening than said pair of grid elements.

15. The system of claim 11 further comprising:

a plasma source power applicator on or adjacent said plasma chamber and a plasma source power supply coupled to said plasma source power applicator; and a process gas supply coupled to said plasma chamber.

16. The system of claim 11 wherein said pair of top surfaces comprise a floor of said plasma chamber.

17. The system of claim 16 wherein said pair of top surfaces are orthogonal to said pair of side walls.

18. The system of claim 11 wherein said pair of grid elements are electrically conductive.

19. The system of claim 11 further comprising respective guard grids lying between respective ones of said grid elements and said opening of said plasma chamber.

20. The system of claim 19 further comprising a middle guard grid lying between said middle grid element and said opening of said plasma chamber.

* * * * *